US005355762A

United States Patent [19]

Tabata

[11] Patent Number: 5,355,762

[45] Date of Patent: Oct. 18, 1994

[54] EXTEMPORANEOUS PLAYING SYSTEM BY POINTING DEVICE

[75] Inventor: Toshiyuki Tabata, Kanagawa, Japan

[73] Assignee: Kabushiki Kaisha Koei, Kanagawa, Japan

[21] Appl. No.: 17,327

[22] Filed: Feb. 11, 1993

Related U.S. Application Data

[63] Continuation of Ser. No. 764,544, Sep. 24, 1991, abandoned.

[30] Foreign Application Priority Data

Sep. 25, 1990 [JP] Japan ..... 2-252000

[51] Int. Cl.[5] ..... G10H 1/06; G10H 1/26

[52] U.S. Cl. ..... 84/609; 84/615; 84/622

[58] Field of Search ..... 84/609–614, 84/622–625, 634–638, 615–620

[56] References Cited

U.S. PATENT DOCUMENTS 4,696,216 9/1987 Asahi et al. ..... 84/609
4,704,682 11/1987 Clynes ..... 84/622 X
4,958,551 9/1990 Lui ..... 84/611 X
4,969,384 11/1990 Kawasaki et al. ..... 84/612
4,991,218 2/1991 Kramer ..... 84/622 X
5,085,116 2/1992 Nakata et al. ..... 84/609
5,204,969 4/1993 Capps et al. ..... 84/625 X

*Primary Examiner*—Stanley J. Witkowski
*Attorney, Agent, or Firm*—Flynn, Thiel, Boutell & Tanis

[57] ABSTRACT

A computer music playing system of the invention permits setting parameters before playing, sound generation control, musical interval control, and special control during playing by merely operating a hand held type position input device. System operability is good, use efficiency is improved, and the computer can be used even if the user does not know music playing technique and musical theory. A hand held type position input device is provided, and by operating the hand held position input device, various selections and various settings in software are executed. The band members can be set, the playing style can be changed by a combination of the setting of the band members and the selection of the music to be played. The operator of the hand held position input device can participate as a member of the band.

13 Claims, 10 Drawing Sheets

FIG. 1

| |
|---|
| LENGTH |
| ROOT |
| COMPOSITION SOUND 1 |
| COMPOSITION SOUND 2 |
| COMPOSITION SOUND 3 |
| COMPOSITION SOUND 4 |
| COMPOSITION SOUND 5 |
| COMPOSITION SOUND 6 |
| COMPOSITION SOUND 7 |

FIG. 2

HARMONY COMPOSITION SOUND DATA

| | | | | | |
|---|---|---|---|---|---|
| LENGTH : 4 BEATS | 4 BEATS | 2 BEATS | 2 BEATS | 4 BEATS |
| ROOT : C | F | C | G | C |
| COMPOSITION SOUND 1 : 1 DEGREE | 1 DEGREE | 1 DEGREE | 1 DEGREE | 1 DEGREE |
| COMPOSITION SOUND 2 : 2 DEGREE | 2 DEGREE | 2 DEGREE | 2 DEGREE | 1 DEGREE |
| COMPOSITION SOUND 3 : 3 DEGREE | 3 DEGREE | 3 DEGREE | 3 DEGREE | 3 DEGREE |
| COMPOSITION SOUND 4 : 4 DEGREE | 5 DEGREE | 3 DEGREE | 4 DEGREE | 3 DEGREE |
| COMPOSITION SOUND 5 : 5 DEGREE | 5 DEGREE | 5 DEGREE | 5 DEGREE | 5 DEGREE |
| COMPOSITION SOUND 6 : 6 DEGREE | 6 DEGREE | 6 DEGREE | 6 DEGREE | 5 DEGREE |
| COMPOSITION SOUND 7 : 7 DEGREE | 7 DEGREE | 6 DEGREE | 7 DEGREE | 5 DEGREE |

ACCOMPANIMENT DATA

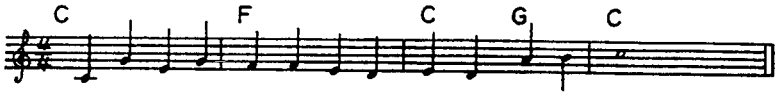

FIG. 3

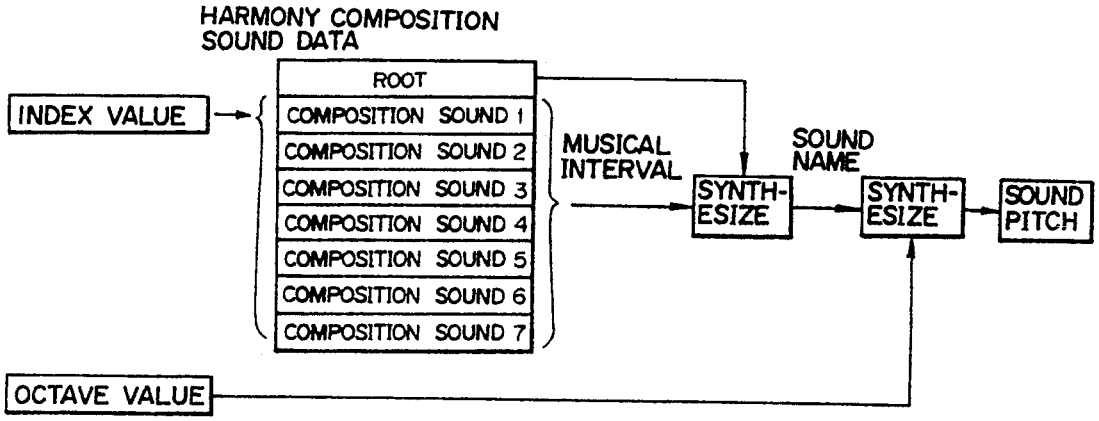

| NAME | PART | SOUND VOLUME | PAN |
|---|---|---|---|
| USER PLAYER | HIPERMERCEL | 100 | L 0 |
| STEEVE GADDODO | FUSION DRUMS | 115 | L 0 |
| GONTA NO.5 | ELECTRIC MARIMBA | 80 | L 0 |
| READY SMOOTH | A.PIANO | 110 | L 0 |
| JACODER | FRETLESS BASS | 110 | R 1 |
| SMILE DAVIS | THE BOSS TRUMPET | 110 | R18 |

EXTEMPORANEOUS PLAYING SYSTEM BY POINTING DEVICE

This application is a continuation of U.S. Ser. No. 07/764,544 filed Sep. 24, 1991, now abandoned.

FIELD OF THE INVENTION

The present invention relates to a playing system of software for permitting extemporaneous playing of music on the basis of prepared data in the field of a computer music using a personal computer.

BACKGROUND OF THE INVENTION

Hitherto, the following methods have been used to perform extemporaneous playing of music by using a computer.

1. A keyboard of the computer is regarded as a keyboard of a musical instrument and music is played.

2. A few playing patterns are prepared and a desired pattern is selected and played.

The first method requires adequate keyboard playing technique and knowledge of musical theory and has a drawback in that, if they are inadequate, where is no guarantee that the music can be correctly played on the basis of the musical theory. The second method has a drawback in that the degree of freedom is low because music other than the prepared patterns cannot be performed, and if the number of patterns which can be selected is increased, the operation becomes complicated.

According to the above methods, therefore, extemporaneous playing having a high degree of freedom and which is accurate with respect to musical theory cannot be realized by simple operations without adequate musical instrument playing technique and adequate knowledge of musical theory.

According to the invention, extemporaneous playing is fundamentally achieved as follows. First, playing data of musical pieces to be played is prepared. The above data includes not only accompaniment data but also harmony composition sound data on the progress of the musical pieces. The accompaniment is subsequently started and played by the computer, and the extemporaneous playing is performed by operating a pointing device (for instance, a mouse) which communicates with the computer. The start and stop of the sound generation are indicated by a button of the pointing device. That is, a sound is generated only when the button is depressed. The pitch of sound which is generated is decided with reference to the harmony composition sound data. The motion of the pointing device is detected every predetermined time (i.e. periodicalily) corresponding to the tempo of the playing, and the sound pitch is changed as required. If the movement amount is large, the sound pitch changes significantly and is raised or dropped in accordance with the moving direction. Fundamentally, although the sound pitch doesn't change in the case where the pointing device is not moved, the sound pitch automatically changes to the correct sound pitch in the case where correction is necessary upon progress of the musical piece.

In recent years, with the advancement of computers, particularly personal computers, a computer of small size, light weight, and high performance has been developed and is used for not only office work but also for communication, education, graphics, and games.

For use with a computer, as well as for use with the widespread home game-playing device there have been developed various kinds of games including a role playing game (RPG), a shooting game, a playing card game, a mah-jongg game, and the like.

Computers are also used in hobby fields such as divination, go (a Japanese game), and the like, or the musical field such as composition and arrangement.

In the conventional playing method for playing by software, there is not a method whereby such playing is performed by using a hand held type position input device which is generally called a mouse and there is also not a method whereby sound generation control, a musical interval control, and other special controls upon playing by software are executed. Instead, in the conventional method, control signals are inputted by keyboard operation. Thus, there are inconveniences in that the inputting operation from the keyboard is very difficult, great skill and experience are needed for the inputting operation, the operability is low, and use efficiency is low.

In the conventional playing method, further, there are inconveniences, such as that since playing technique and musical theory are necessary, a person who knows none of the playing technique and the musical theory cannot use such an apparatus.

According to the invention, in an attempt to eliminate the above inconveniences, in a playing method in which software is inserted into a computer, the computer is operated by a keyboard, and sound is generated from a speaker through a sound Source, the playing method is characterized in that a hand held type position input device is provided. By operating the hand held type position input device, various kinds of selections and various kinds of settings in the software are executed, for example so that band members are set or a playing style is changed by a combination of the setting of band members and the selection of the titles of music to be played, an operator of the hand held type position input device can be allowed to participate as a member of the band, and sound generation control, musical interval control, and special control upon playing are executed by the hand held type position input device.

According to the invention as mentioned above, the titles of the music to be played in the software are selected by the hand held type position input device, the band members are selected, (the playing style being determined by the combination of the setting of the band members and the selection of the titles of the music to be played), the operator of the hand held type position input device can be allowed to participate as a member of the band, and sound generation control, musical interval control, and special control upon playing of the music by the playing software are executed.

BRIEF DESCRIPTION OF THE DRAWINGS

The invention will be described hereinbelow in conjunction with the attached drawings, in which:

FIG. 1 is a diagram of harmony composition sound data used by the computer of the present invention.

FIG. 2 is a diagram of playing data used by the computer of the present invention.

FIG. 3 is a control diagram of how the decision of sound pitch is made.

DETAILED DESCRIPTION

Figure 4:
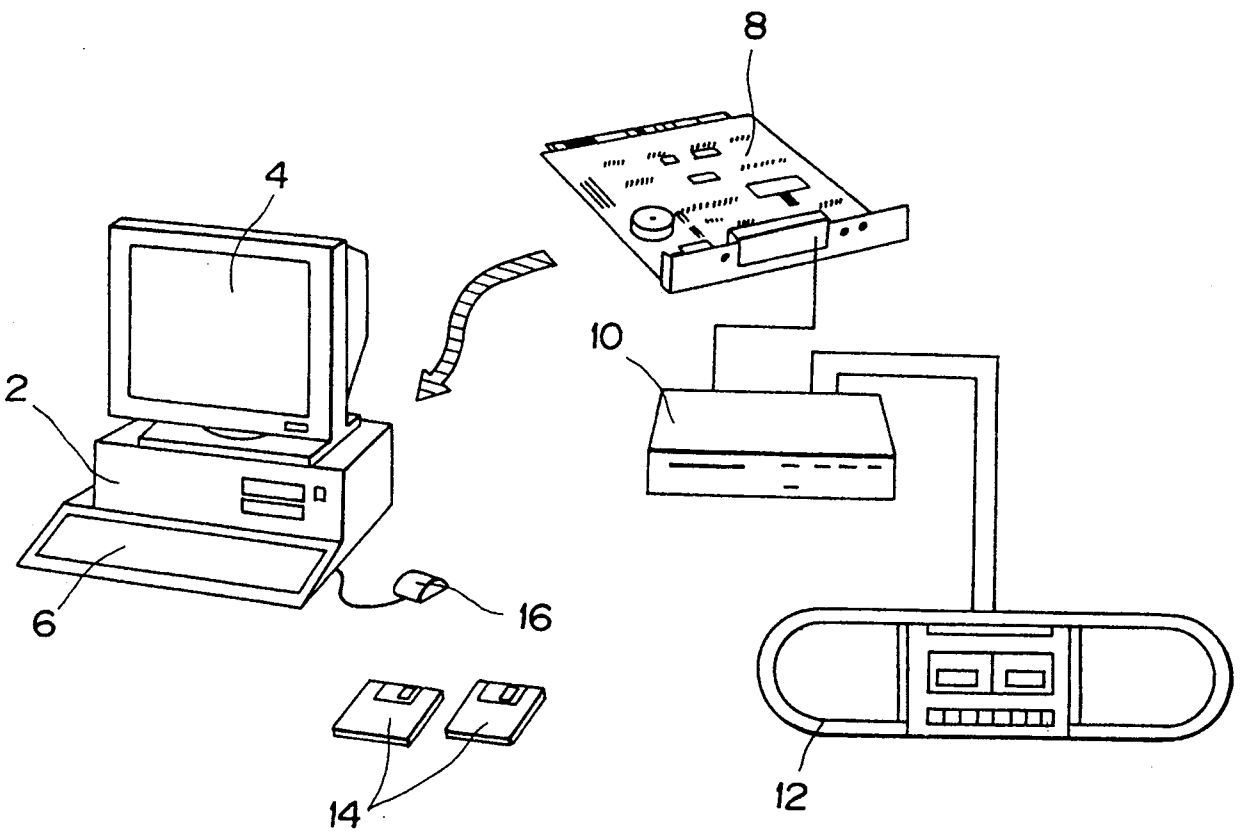
FIG. 4 is a schematic constructional diagram of a hand held type position input device and other components used for performing the software music playing method of the invention.

The invention is implemented using a conventional computer unit 2, such as a personal computer, and a conventional pointing device 16, such as a mouse, as illustrated in FIG. 4. The number of composition sounds (i.e. notes), of the harmony composition sound data is set to 7 and the mouse is used as a pointing device.

In the above conditions, the harmony composition sound data is as shown in FIG. 1. In the diagram, a radical region relates to a sound name of a root of the harmony, and composition sounds 1 to 7 relate to musical intervals associated with the harmony composition root. A length region relates to a length of time during which the harmony composition sound data can be played. The harmony composition sound data and the accompaniment data of FIG. 2 are stored in a memory of the computer unit 10. By allowing the root of the harmony composition sound data to correspond to the accompaniment data as shown in FIG. 2, the playing data for extemporaneous playing is constructed. For example, the computer can be programmed so that, while the accompaniment is being played using the accompaniment data, the computer accesses harmony composition sound data whose root corresponds to the accompaniment data currently being used, as illustrated in FIG. 2.

The movement of the mouse is detected and used as follows.

Up/down direction data and a movement amount are detected from the motion of the mouse and are decomposed to an index value and an octave value. The index value has a range corresponding to the number of harmony composition sounds, which range is set to 7 in the disclosed embodiment. If the up/down direction data indicates the up direction, the index value increases in accordance with the movement amount.

At this time, if the index value exceeds the upper limit in the range of the index value, it is corrected to a value within the preset range and the octave value is increased accordingly. Similarly, if the direction data indicates the down direction, the index value decreases.

For example, an index value of 9 is two notes beyond the preset range of 7. The computer will automatically change the octave value by 1 to select the next octave, and then consider the index value to be 2 with respect to the newly selected octave.

The sound pitch is determined as follows.

The index value indicates one of the composition sounds of the harmony composition sound data, and the sound name (i.e. the note) is obtained by the musical interval and the root of the composition sound. Further, the sound pitch is determined from the sound name and the octave value. FIG. 3 shows a conceptual diagram.

The state of the mouse button is detected and used as follows.

The start and stop of the sound generation are controlled from a state of the depressed mouse button. When the mouse button has been depressed, the sound generation is started so long as no sound is already being generated. The pitch of any sound which is already being generated at this time has already been determined according to FIG. 3. If a sound is already being generated, the sound pitch determined from the movement of the mouse and FIG. 3 is compared with the pitch of the sound which is already being generated. If they differ, the sound is again generated at the sound pitch which has newly been decided.

When playing is started, the accompaniment is executed using the accompaniment data, and the first harmony composition sound data (i.e. the first note) of the extemporaneous playing is set according to FIG. 3. With the progress of the play, the processes of detection of movement of the mouse, decision of sound pitch, and detection of the state of the mouse button are executed, and extemporaneous playing is performed. Further, when the playing time of a length shown in the length region of the harmony composition sound data has elapsed, the next set of harmony composition sound data is selected by the computer (see FIG. 2). At this time, if the sound is generated by depressing the mouse button, the sound pitch decided by FIG. 3 is compared with the pitch of the sound which is already being generated (if any). If they differ, the sound is again generated at the sound pitch which has newly been decided.

When the playing data reaches the end, the play is finished.

According to the extemporaneous playing system of the invention mentioned above, extemporaneous playing can be arbitrarily and accurately performed on the basis of musical theory under the control of the sound generation and the musical interval by simple operations of the mouse.

FIGS. 4 to 20 show another embodiment of the invention. In FIG. 4, reference numeral 2 denotes a computer main body of a personal computer; 4 a CRT as a display; 6 a keyboard; 8 a MIDI interface board; 10 a sound module as a sound source; 12 a speaker or an audio reproducing apparatus of a radio tape cassette player or 20 the like; 14 a floppy disk in which a program software has been stored; and 16 a hand held type position input device, i.e. a mouse.

Figure 5:
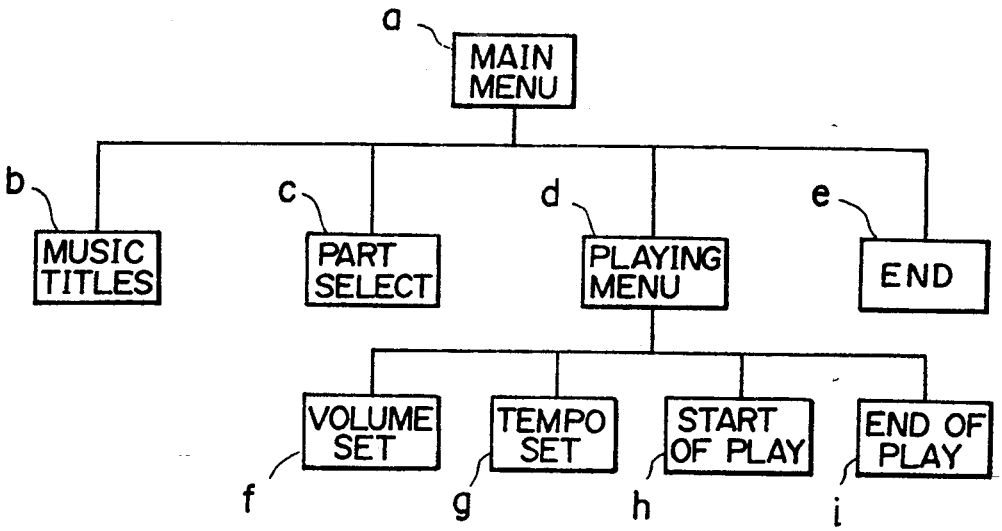
FIG. 5 is a system diagram of a computer program according to the invention.

The program software which is stored In the floppy disk 14 has a system as shown in FIG. 5. That is, the program software is divided from a main menu a to a selection b of the titles of music to be played, a part selection c, a playing menu d, and an endue, respectively. The program software is further divided from the playing menu d to a sound volume setting f and a tempo setting g, a start h of play, and an end i of play.

Figure 6:
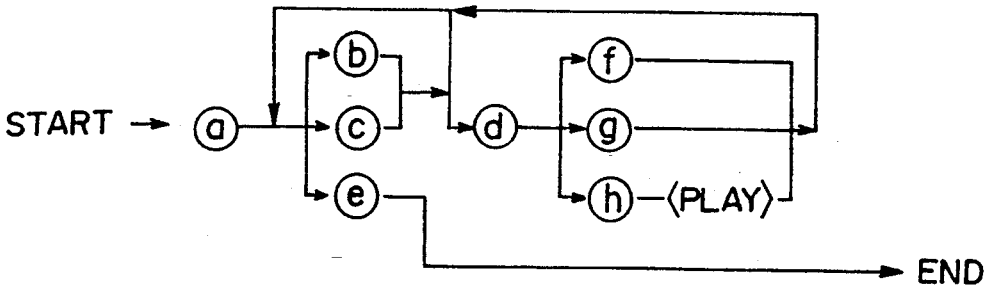
FIG. 6 is a diagram showing the flow of the execution of the FIG. 5 program.

A flow of the execution of the program software is shown in FIG. 6.

In the program software, a band is virtually set in the program upon session playing and the band play is simulated.

The program software has the following features.

Extemporaneous computer play

In conventional personal computer music, generally, only the given data is played (sequencer). However, according to the program software of the invention, a band is presumed and the playing of members of the band is simulated. The playing of the members is not uniform in order to provide extemporaneousness. On the other hand, there are a variety of playing styles in dependence on a combination of the members of the band or a combination of the band and the titles of the music to be played.

Participation of user in session

The user can participate as a member of the band for a session play. This means that a new entertainment capability is provided to personal computer music.

Realization of simplicity of user's operation by computer support

Although it is considered that playing technique and musical theory are necessary to play musical pieces, the operation is extremely simplified and the user is made free from the technique and theory by the computer support. Thus, the entertainment capability is further improved.

In the above program software, the band plays a main role in the session play. Therefore, a construction of the band is set as follows on the assumption of all of the playing styles.

Backing

The backing is a part which is played by the computer. The backing part has a unique playing pattern and such a pattern is played in accordance with the title of the music.

Melody

The melody is a part which is played by the computer. The melody part is not extemporaneous and is peculiar to the title of the music performed.

User

The user is a part which is played by the user. The operation by the user is executed by the hand held type position input device 16, and extemporaneous playing is performed by operation of device 16 in accordance with the title of the music.

The MIDI interface board 8 and the sound module 10 as a sound source are used by the program software to play the music. All of the playing data is sent from computer 2 as an MIDI message to an MIDI bus. Sounds are generated by the MIDI interface board 8 and the sound module 10 in response to the playing data on the MIDI bus.

The MIDI system is used because the MIDI interface board 8 and the sound module 10 are inevitable to perform the session play, the MIDI system is practically a standard system in computer music, and because development capability of the system is large.

To realize session play, the following data is prepared:

Chord track data—data regarding the titles of music

Member data—data regarding tile performers

Sequence data—data which is sent to the MIDI bus.

The data of the program software comprises step data, sequence data, chord track data, and member data.

The step data is data of one note and is fundamental data when a note event is sent to the MIDI bus. As terms in the data, there are the following terms.

Note—denotes a musical internal of the note

Step time—denotes a time until the next step data is processed

Gate time—denotes a duration of the note (rest in the case of gate time=0)

Velocity—denotes an intensity at which the sound of the note is generated (rest in the case of velocity=0)

The sequence data is data of the note which is played. The sequence data is constructed by the step data such that the MIDI note number has been stored in the note.

The step data is numerical data to allow computers to process music elements, i.e., sound pitch, lengths, and intensity, and one note on a staff (i.e., one step data) is expressed in a unit of 1-step. The way in which a musical piece continues is represented in the order of the notes or rests described on the staff. The sequence data is the step data arranged in an identical way to the sequence given on the staff (i.e., a collection of the step data). In addition to the pitch, lengths, and intensity, the step data consists of the aforementioned four elements of information used in data processing. These elements of the step data will be described in detail below.

Notes represent sound pitch. This is numerical data on the positions (heights) of the notes given on the staff.

Step time indicates the period of time between the step data of interest and subsequent step data processing. It usually corresponds to the sound lengths expressed in the form of the notes on a staff. In the software, the length of a quarter note corresponds to 48-step time periods.

Gate time indicates how long sounds should be produced (or enunciated). In music, actually produced sounds are incomparable on lengths to notes of certain length (such as quarter notes), as is the case with staccatos or tenutos on a staff. The gate time is thus required before notes are represented. When the gate time is zero, rests are expressed in the absence of the lengths of the sounds to be produced.

The velocity indicates the degree of sound intensity. This is the data showing numerical intensity sufficient to produce sounds, being usually expressed in dynamic symbols (such as fortes) on a staff. Since a velocity of zero indicates a sound failure, rests are expressed when the velocity is zero.

The chord track data is data of the titles of the music to be played. This data represents a musical piece in the software.

The chord track data consists of four elements: bar/-pattern attribute data; chord-organized sound data; ending data; and melody data.

The elements of the chord track data will be described below:

Bar/pattern attribute data illustrates bars (i.e. measures) on a staff and contains pattern attributes for each bar. Notes are assembled into one bar, and a collection of the bars are formed into a musical piece. To show the state in which the bars are gathered together, the respective lengths of time measured from the beginning of the musical piece to each of the bars are expressed as numbers, and then arranged to represent the bars on the staff.

In this software, the parts referred to as backing parts are performed based on pattern data (discussed below) of part members being matched to a continued musical piece. The members of a backing part have several sets of pattern data, and the pattern attribute data provides information for specifying the pattern to be performed for the bar of interest.

Chord-Organized Sound data

This data shows chords at respective parts of a musical piece, containing information on chord-organized sounds and the lengths of time for the chord. The chord is a synthetic sound by which two or more sounds of different pitch are generated concurrently. The pitches of the individual sounds that constitute the chord expressed as numbers to provide information on the chord-organized sounds, with the length of time applied to the chord also being added to such information. The chord-organized sound data can be achieved by the above information being arranged according to a continued musical piece.

Ending Theme

This data represents the sound form of rhythm at the ending (the last part) of the musical piece. Rhythm is a relationship between time and sounds in music, namely, a form produced by a combination of short-long sounds. The software provides several different sets of ending data for each musical piece, permitting variations in performance.

Melody Data

This is sequence data used to perform fixed parts (characteristically main melodies) in a musical piece. Sequence data is discussed in detail below.

The member data provides information on the members or musicians that perform respective parts of a musical piece. Member data includes the following types of data.

Member Attribute Data

Members or performers are broadly divided into the following three attribute categories. The member attribute data provides information as to which category the member data of interest falls under. The categories are: backing; user; and melody.

The backing category indicates that backing performances are carried out by the computer. Member data with backing attributes has intrinsic pattern data (discussed below), by which the performances are achieved as specified by pattern attribute data in chord track data.

The pattern data also falls into three, different classes according to its characteristics: a mono-part; poly-part; and rhythm-part (discussed below).

The user category indicates that the player himself or herself controls the software. Performances are carried out by the player using the mouse.

The melody category indicates that melody performances are conducted by the computer. Melody data from the chord track data is performed.

Pattern Data

Pattern data is included in the member data only when the member attribute data is specified as backing. The pattern data defines sequence data equivalent in length to one bar, and notes (i.e. step data) are represented in the pattern data by organized-sound reference numbers, octave data, and halftone data in place of sound pitch with mono-parts or poly-parts. The organized-sound reference number provides information as to which organized sound should be referenced in the chord-organized sound data. The octave data provides information as to whether or not the octave of the sound pitch derived from the organized-sound reference numbers and the chord-organized sound data should be higher/lower. The halftone data provides information as to whether or not the sound pitch should further be sharped/flatted by a halftone.

The procedures described above determine actual sound pitch.

Quantizing Data

Quantizing data is included in the member data only when the member attribute data is specified as user. Quantizing data establishes the minimum unit of step time for the user's performances. The timing of a musical interval to be automatically varied will correspond to a multiple of the step time period if the mouse is operated so that the musical interval may be required to change while being enunciated (i.e., the pointer is moved while the left button is being held down). For example, with the quantizing data set to eighth notes, the timing of an automatic variation will correspond to one of eighth, quarter, dotted quarter, half notes and so on (i.e. multiples of an eighth note).

The pattern data can have a monophonic characteristic, meaning that only a single sound is enunciated at a time and two or more sounds are not enunciated simultaneously, a polyphonic characteristic, meaning that two or more sounds are enunciated simultaneously, or a rhythm characteristic indicating that there are no sound categories (sound pitch) on enunciation, as is the case with percussion instruments.

A playing system will now be described.

A unit time of the play is expressed by the step time, 48-step time units correspond to a quarter note, and one measure has a maximum time of 192-step time units. Playing tempo is determined based on the real time of one-step time period.

The playing process has six parts (for example, see FIG. 17), where one member is assigned to one part, and for the play, all of the parts are simultaneously processed. The playing method of each part is determined by the kind of member.

The main process in the play is the sound generation. To generate sound from the sound source module connected to the MIDI bus, a note on/off event is transmitted as an MIDI message to the MIDI bus. The message is constructed by the musical interval (MIDI note) and the sound volume (velocity). The data of every part is processed on a one-step time unit basis and a note on/off process is executed.

As a playing state, a state in which a note-on has been transmitted, namely, a state during the sound generation is called a key-on. A state in which a note-off has been transmitted is called a key-off.

The play of the backing part is based on the pattern data which is determined by the bar/pattern attribute data of the chord track data. The playing methods of the monophonic and polyphonic characteristics are the same except a difference with respect to whether a harmony is handled or not. However, the playing method of the rhythm differs from monophonic and polyphonic because an interpretation of the MIDI note differs. A playing procedure of the backing part will now be described hereinbelow.

Musical performances are conducted using sequence data produced based on the chord track data and member data. The following procedures are included in the implementation process of the program that generates the sequence data.

Bar processing (i.e. measure processing) extracts bar/pattern attribute data in turn from the chord track data, and produces sequence data for one bar. Extracting the bar/pattern attribute data will determine the length of that particular bar, and will also determine the pattern data to be performed if the member attribute data is specified as backing, followed by chord processing. When the end of the bar/pattern attribute data is reached, the ending of the musical piece is performed and then completed, as required by the ending data.

Chord processing extracts chord-organized sound data in turn from the chord track data at a stage in bar processing. Chord processing will determine the length of that particular chord and the pitch of each sound that makes up the chord, followed by pattern expansion processing if the member attribute data is specified as backing. The chord processing is repeated before a chord length reaches a bar length.

Those parts of the member data in which the member attributes specify backing are processed at a stage in chord processing. On monophonic or polyphonic parts, sequence data is produced from the pattern data and the chord-organized sound data. On rhythm pants, the pattern data itself is the sequence data. This use of pattern data to produce sequence data is called pattern expansion processing.

As mentioned above, the sequence data is sent to the MIDI interface.

The step time is adjusted in a range in which the total step time of the present pattern doesn't exceed the length of the chord. A similar adjustment is also executed with respect to the gate time.

The pattern expansion process is executed until the end of pattern data or until the end of the chord. In the case where the playing position doesn't reach the end of the measure at the time of the end of the pattern data, chord processing is repeated with the same pattern data. After completion of the measure, measure processing is repeated and the next pattern is developed.

The above processes are executed until all of the measures are finished.

The melody part is played by directly transmitting the melody data of the chord track data to the MIDI bus, so that no special process is involved.

The user part is played by operating the hand held type position input device of the user. Although the musical interval of the sound which is actually generated is determined by the chord-organized sound data of the chord track data in a manner similar to the backing part, no playing pattern exists.

Upon playing, the data of the hand held type position input device is obtained every one-step time. As data which is obtained, there are a depressing state of the button and a position of the pointer. The sound generation and the musical interval are respectively controlled by the above data. The user may generate only one sound at a time, and harmony cannot be played by the user.

Each control in the user part will now be described in detail.

The control of sound generation is performed by a left button of the hand held type position input device. At a time point when the depressing state of the left button has been shifted, the playing state is shifted. When the left button is depressed, a key-on state is set. When the left button is released, a key-off state is set.

The control of the musical interval is executed by the movement of the hand held type position input device. The distance and direction of the pointer are obtained on the basis of the present pointer position when the playing state has been shifted, and the immediately presenting pointer position, thereby changing the musical interval. In other words, the distance and direction of pointer movement are determined by comparing the pointer positions before and after the pointer movement.

That is, to first generate the sound, a cursor on screen 4 is moved in correspondence with pointer 16 while depressing the left button of pointer 16. By sliding pointer 16, a tone of the user part is deviated. By releasing the left button, no sound is generated.

Figure 7:
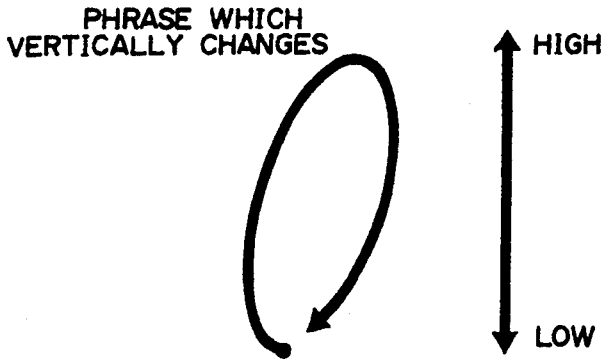
FIG. 7 is an explanatory diagram illustrating how sound pitch is changed.

As shown in FIG. 7, by moving the cursor in the upper direction, the sound pitch is raised. On the contrary, when the cursor is moved in the lower direction, the sound pitch lowers. For instance, when the cursor is rotated a few times, a sound whose pitch changed in the up/down direction can be formed.

Figure 8:
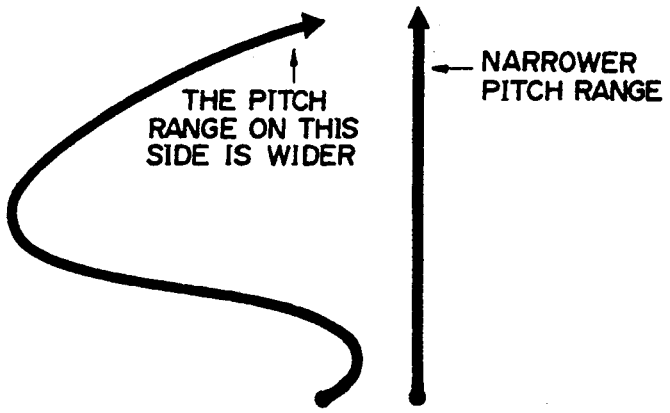
FIG. 8 is an explanatory diagram showing how a wide pitch compass is established.

When a wide compass of sound pitch is desired, as shown in FIG. 8, by smoothly moving the cursor in a curved path in the up/down direction while depressing the left button, the play in a wide compass can be expressed. Thus, the curved cursor path causes the pitch range of the screen to increase beyond the pitch range associated with the straight cursor path.

Figure 9:
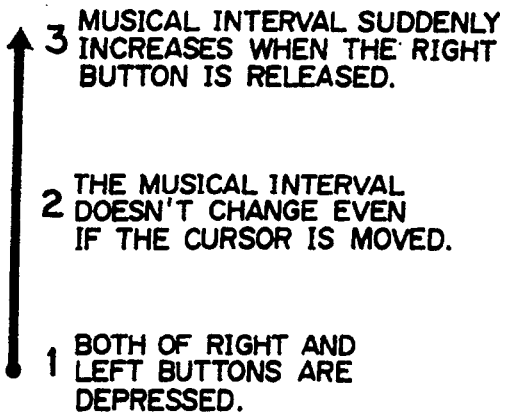
FIG. 9 is an explanatory diagram showing how a sound is continued even during cursor motion.

To continue the sound, as shown in FIG. 9, by depressing the right button while depressing the left button, the musical interval of the sound generated by the left button is continued. At this time, even if the cursor is moved in the up/down direction, the musical interval doesn't change, such that the same note is maintained during the movement.

Figure 10:
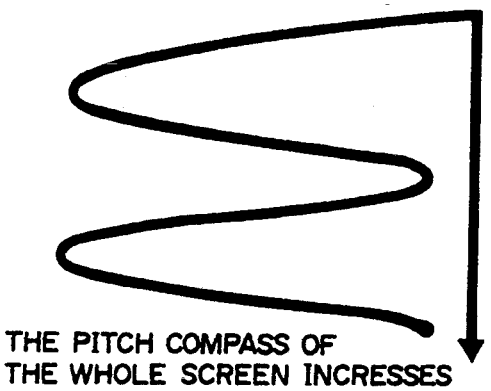
FIG. 10 is an explanatory diagram showing how the pitch compass on the screen is increased.

When the compass on the screen is to be shifted up or down, for instance, when the compass of the sound which is being played is to be slightly shifted up, as shown in FIG. 10, it is proper to largely perform the movement in the up direction. That is, if the cursor is moved up in a zigzag manner while depressing the left button and is then moved down in a straight line, a width of the movement in the up direction increases and the compass of the whole screen becomes high (i.e., the pitch range of the screen is increased).

Figure 11:
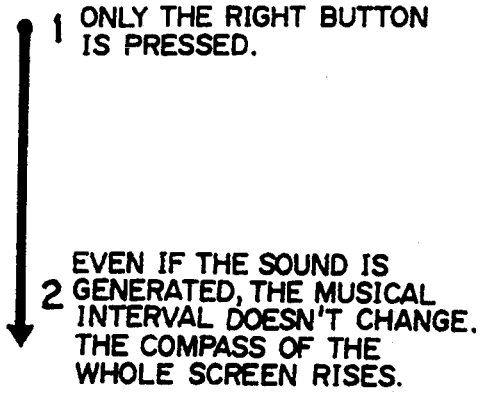
FIG. 11 is an explanatory diagram of a technique using the right button of the hand held type position input device.

As a technique of the right button of the hand held type position input device, as shown in FIG. 11, when the right button is depressed without depressing the left button and the cursor is moved, the musical interval (i.e. note) doesn't change. That is, when the sounds have been generated before and after the movement of the cursor, so long as a reference sound doesn't change, the same sound can be generated after cursor movement. Further, in the case where the cursor is located at the top of the screen in spite of the fact that the user wants to further raise the musical interval above the musical interval of the sound which is at present being played, it is sufficient to move the cursor down by the above method (with the right button depressed) and, thereafter, to generate the desired higher sounds by moving the cursor upward.

The operations of the hand held type position input device can be summarized as follows.

| Left button | Right button | Function |
|---|---|---|
| ON | OFF | The sound is generated. If the cursor is moved as it is, the sound changes in accordance with the width of movement. |
| ON | ON | The sound is continued even during cursor movement. When the cursor is moved and the right button is released, the sound is generated according to cursor position, while skipping the sounds during such a period of time that the right button was ON. |
| OFF | ON | No sound is generated. Even if sound is generated by depressing left button after the cursor was moved, the musical interval doesn't change. |
| OFF | OFF | No sound is generated. |

The user part in the musical interval control has a sound generation range of 7 sounds×5 octaves, and the notes are therefore expressed by 0 to 34. By adding or subtracting a distance amount to the present note value in accordance with the direction of cursor movement, a new note value is obtained and is accumulated as a present note value.

A chord organization sound is determined from the remainder which is obtained by dividing the present note value by 7. The quotient which is obtained by dividing the present note value by 7 is used as an octave and is set to the MIDI note which is actually sound generated. Thus, note number 30 is the second note in the fifth octave, because $30 \div 7 = 4$, remainder 2.

In the case of the key-off at present, the processes are finished here. In the case of the key-on, if the resultant MIDI note differs from the MIDI note which is at present being sound generated, and if the step time remaining in the present measure can be completely divided by a minimum time defined by the quantizing data, the note is transmitted. Upon transmission, the note which is at present being sound generated is turned key-off and the new note is turned key-on. Thus, the new note is played if there is enough time left in the measure to accommodate a new note.

There is a holding function as a special control. The holding function is executed by the right button of the hand held type position input devices. Namely, at a time point when the depressing state of the right button has been shifted, the holding state is shifted. When the right button is depressed, a hold-on state is set. When the right button is released, a hold-off state is set. When the mode is shifted to the hold-on state, the present playing state is locked and the operations of the sound generation control and musical interval control are made invalid until the hold-off state is set. When the mode is shifted to the hold-off state, the sound generation control and the musical interval control are made valid. If the playing state is in the key-on state at that time, then the key-off state (namely, a clear state) is forcedly set.

The operation will now be described in accordance with each screen of the playing software.

Figure 12:
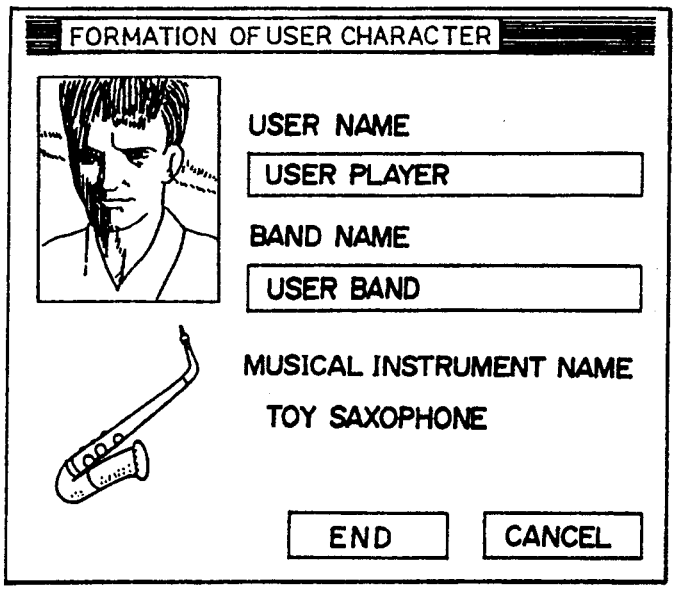
FIG. 12 is a diagram showing a screen used to form a user character.

First, "Start game newly" is selected from the initial screen and a user character is farmed as shown in FIG. 12. In the setting of the user name upon formation of the user character, a user name of up to 22 characters can be input. In the case of omitting the input, the user name of "USER PLAYER" is automatically written. In the setting of the band name, the band name is input. In the case of omitting the input, the band name of "USER BAND" is automatically written. The band name can be changed later. In the setting of the face of the user, when a graphic image of the face on the screen is clicked by the hand held type position input device, the kind of face is switched and a desired face can be selected.

In the selection of the musical instrument, when a graphic image of the musical instrument on the screen is clicked by the hand held type position input device, the kind of musical instrument is switched. Five available musical instruments are a distortion guitar, an electric guitar, a saxophone, a violin, and a trumpet.

At the end of each setting, "END" is clicked. When "CANCEL" is clicked, all of the settings which have been performed are made invalid and the screen is returned to the initial set screen.

Figure 13:
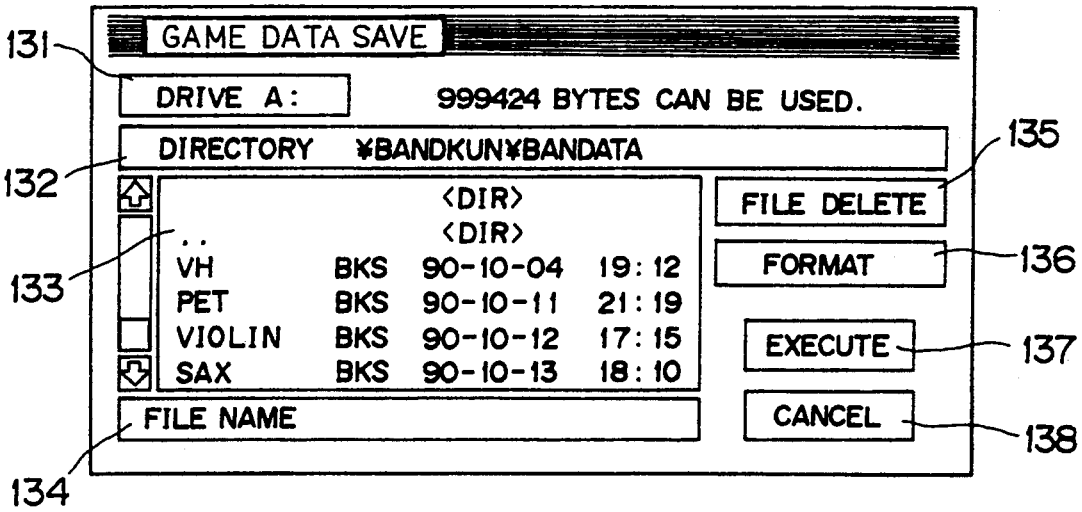
FIG. 13 is a diagram showing a screen for saving game data.

As shown in FIG. 13, the operating mode is shifted to the game data saving mode and the saving or loading of the game data is selected. In FIG. 13, 131 indicates the present driving position. When the frame is clicked, the disk drive can be changed. In FIG. 13, 132 denotes a directory; 133 a file list; 134 a file name; 135 a file deletion; 136 a format to form saving disks; 137 an execution to instruct the Start of the operation to save, load, or delete the file; and 138 a cancel to cancel the filing operation.

Figure 14:
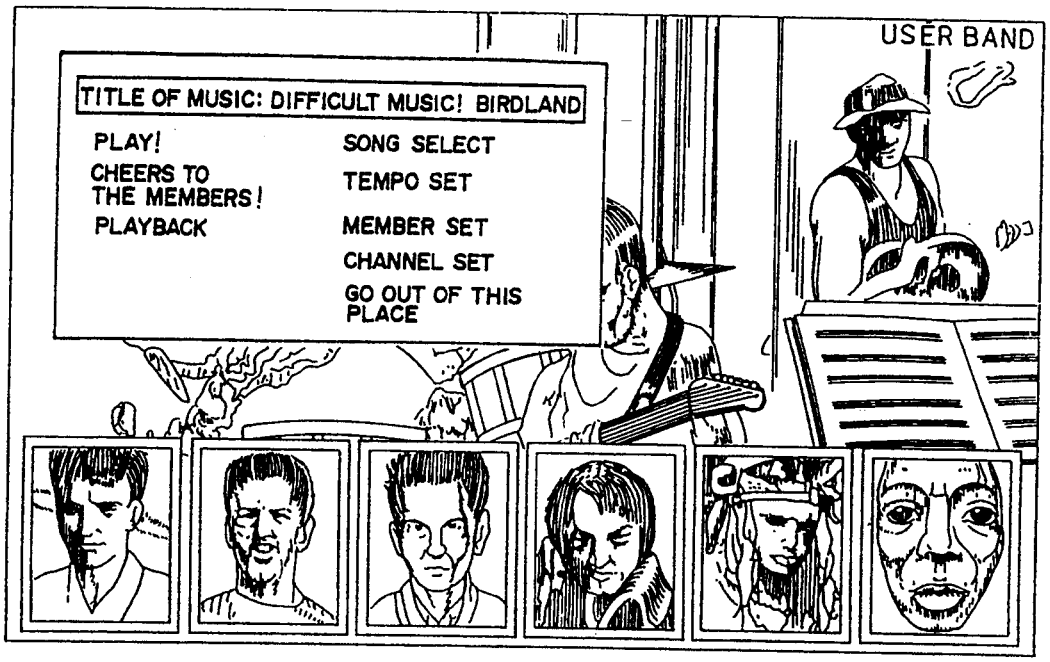
FIG. 14 is a diagram showing a main menu.
Figure 15:
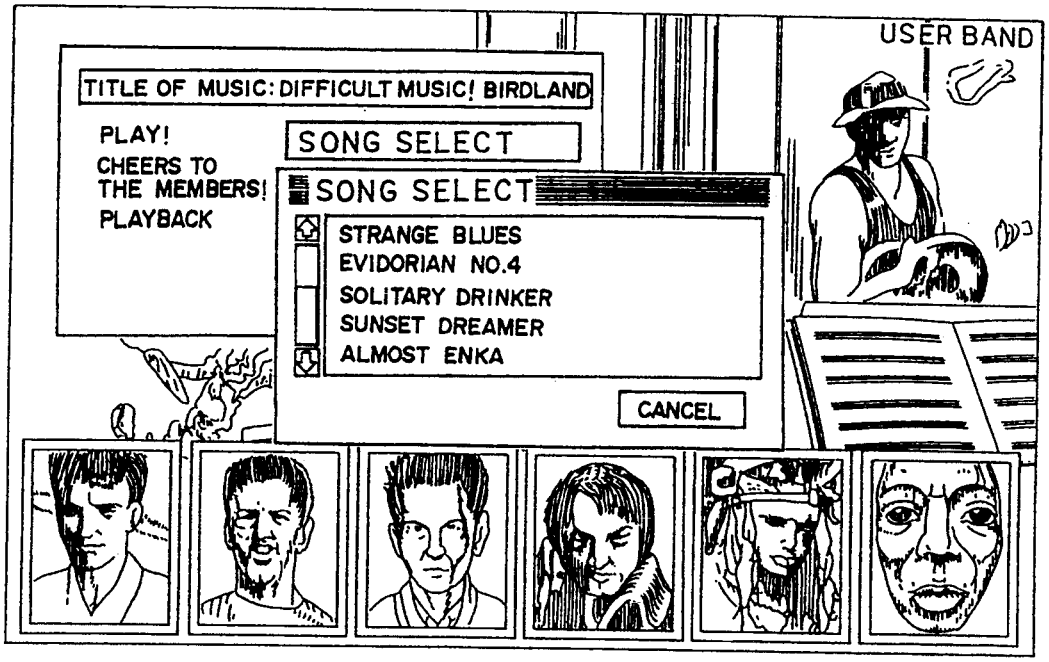
FIG. 15 is a diagram showing a screen for selecting songs.

A main menu of the play executing portion is shown in FIG. 14. When "SONG SELECT" is clicked in the main menu, a music title selecting screen (see also block b in FIG. 5) is displayed as shown in FIG. 15.

Figure 16:
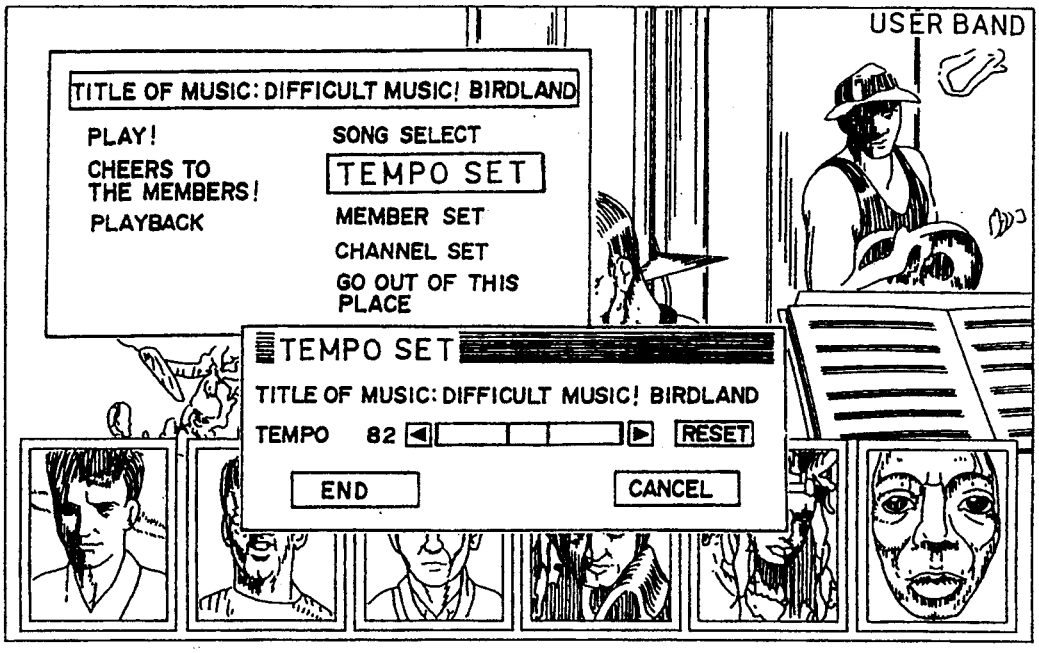
FIG. 16 is a diagram showing a screen for setting tempo.

When "TEMPO SET" is clicked in the main menu, the tempo upon playing can be set as shown in FIG. 16 (see also block g in FIG. 5).

Figure 17:
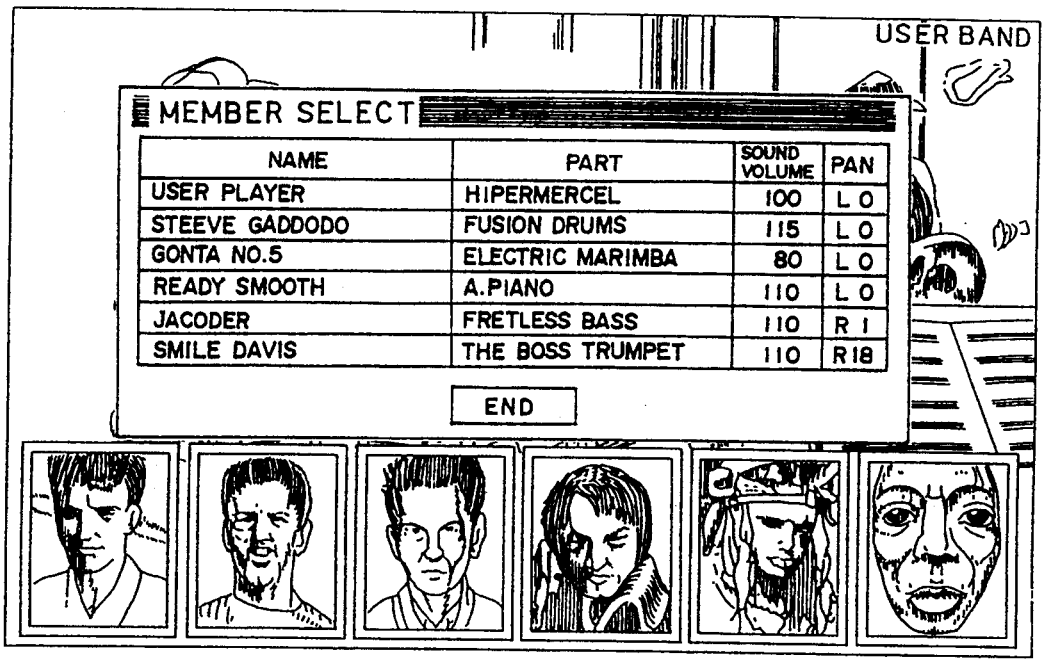
FIG. 17 is a diagram showing a screen for selecting members.

When "MEMBER SET" is clicked in the main menu, the window of FIG. 17 (MEMBER SELECT) is first invoked, and it is possible to finely set every part as shown in FIG. 17 (see also block c in FIG. 5). The member selection denotes a selection of the part.

Figure 18:
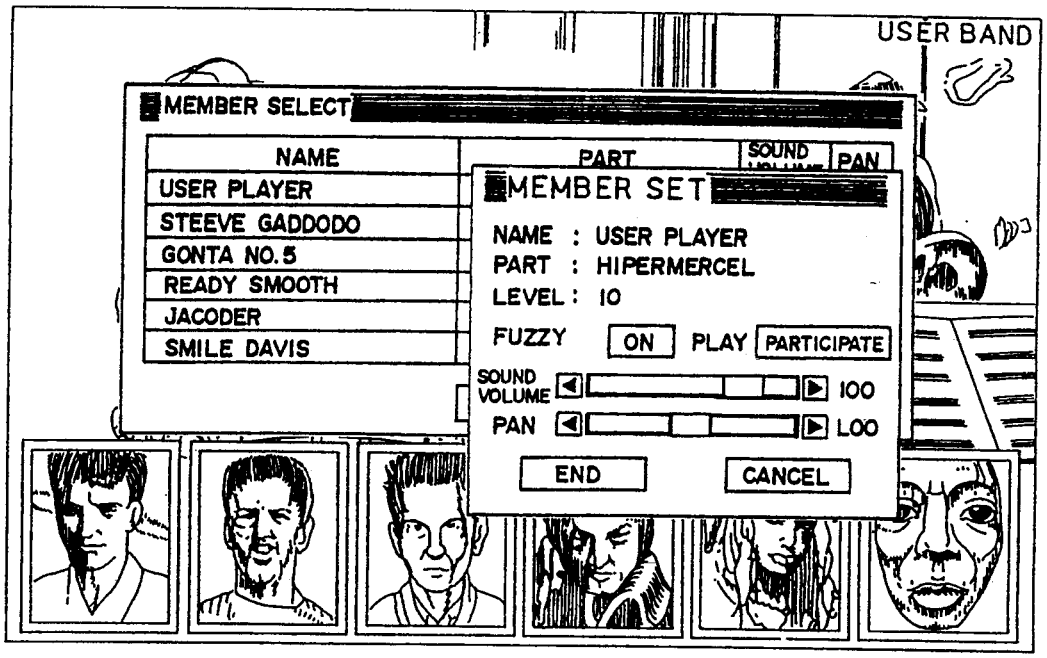
FIG. 18 is a diagram showing a screen for setting members.

When "MEMBER SET" is clicked in the main menu, and when the user is selected in "MEMBER SELECT" (FIG. 17), the window of FIG. 18 is invoked. In FIG. 18, the sound volume upon playing, pan (sound image orientation), participation (ON/OFF) to the play, and a fuzzy mode (musical interval correcting function) are set by the hand held type position input device of the user.

Figure 19:
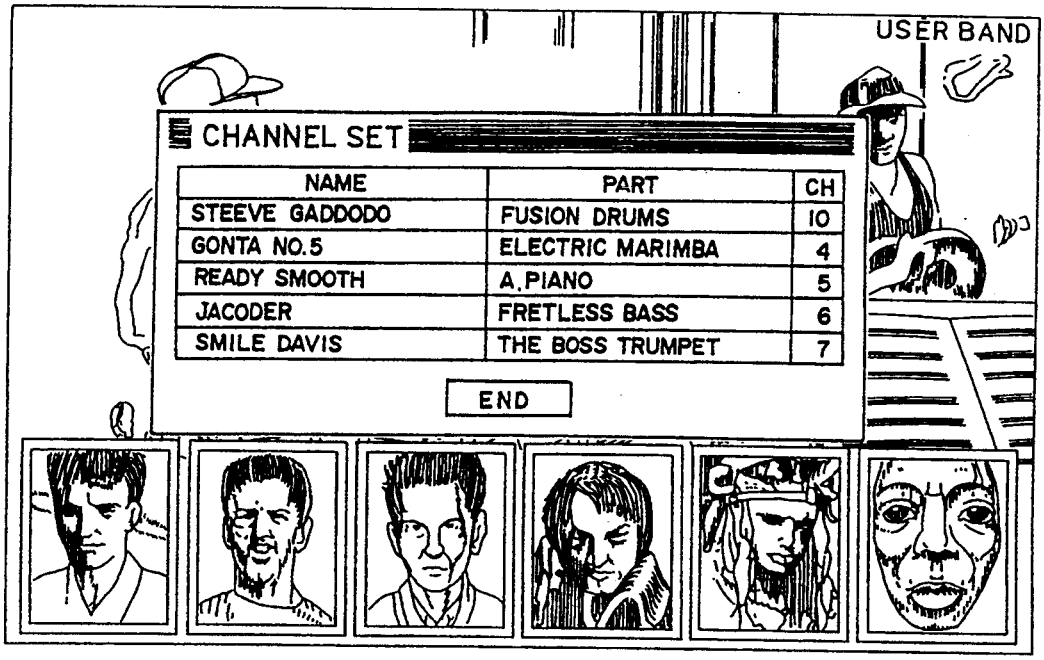
FIG. 19 is a diagram showing a screen for setting channels.

When "CHANNEL SET" is clicked in the main menu, the parts can be rearranged as shown in FIG. 19 although it is not directly concerned with the play.

Figure 20:
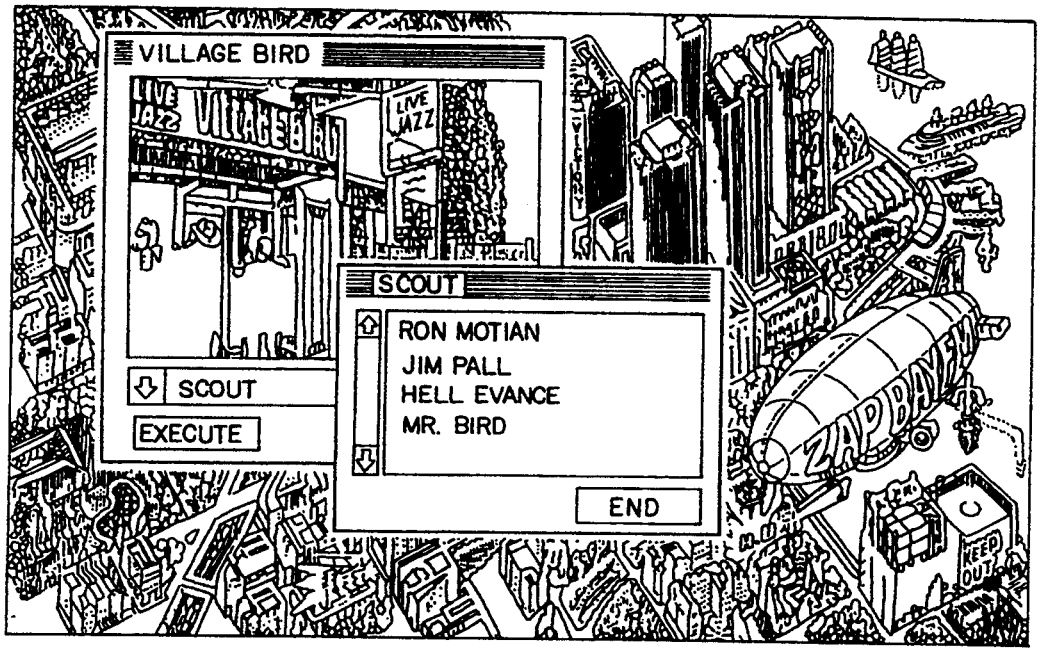
FIG. 20 is a diagram showing a screen for scouting.

Another menu of the software is a visible map at the background of FIG. 20. On the map, there are various locations (such as a park, studio, or hall), and choosing these will bring up menus by which implementation can be achieved at the individual locations. For example, the menu displaying the "Village Birds" that is illustrated by FIG. 17 shows the selected location referred to as village birds on the map. As shown by FIG. 20, a "SCOUT" feature is displayed in this menu, and clicking "Execute" will call the "SCOUT" menu.

The "SCOUT" menu shows the names of the members to be scouted out at that time (four names appear in FIG. 20), and clicking a desired member name will provide the membership of the band. Being a member of the band is nothing less than placement of parts for backing performances.

When "SCOUT" is clicked, a selecting operation of each part of the back play (accompaniment) is executed as shown in FIG. 20. The "SCOUT" feature is set to scout the band members and to allow them to take charge of each part.

After completion of each setting, when the user part is played by the hand held type position input device, the sound generation control, musical interval control, and special control are executed.

Thus, the setting before playing and the sound generation control, musical interval control, and special control during playing can be executed by only the operation of the hand held type position input device. The operability is good and the use efficiency is improved.

Since the computer can be used even if the user doesn't know the playing technique and the musical theory, the person who doesn't know the playing technique and musical theory can operate the system with the feeling of a game. The generality can be increased. Particularly, children can learn the playing technique and musical theory or the computer operation during playing. It is practically advantageous.

Although the MIDI interface board and the sound module have been provided separately from the computer main body in FIG. 4, they can be also provided in the computer main body.

As described in detail above, according to the invention, by operating the hand held type position input device, various selections and various settings in the software are performed, the band members are set, the playing style is changed by a combination of the setting of the band members and the selection of the titles of the music to be played. The operator of the hand held type position input device can participate as a member of the band. The sound generation control, musical interval control, and special control upon playing are executed by the playing software. Therefore, the setting before playing and the sound generation control, musical interval control, and special control during the play can be executed by merely operating the hand held type position input device. The operability is good and the use efficiency can be improved. Since it is possible to use the computer even if the user doesn't know the playing technique and musical theory, even the person who doesn't know the playing technique and musical theory can operate the computer with the feeling of a game. The generality can be increased.

Although particular preferred embodiments of the invention have been disclosed in detail for illustrative purposes, it will be recognized that variations or modifications of the disclosed invention, including the rearrangement of parts, lie within the scope of the present invention.

The embodiments of the invention in which an exclusive property or privilege is claimed are defined as follows:

1. In a music playing method including the steps of inserting software into a computer, and operating the computer to generate sound from a speaker through a sound source, the improvement comprising the steps of:

providing a hand held type position input device which is coupled to the computer, operating the hand held type position input device to select musicians for a band from a predetermined set of musicians, and to select music to be played, causing the computer to generate sound representative of the selected music as performed by the selected musicians of the band, and using the hand held position input device to execute sound generation control and musical interval control causing the computer to selectively generate a further sound which varies in pitch substantially simultaneously in response to operation of the hand held position input device during said step of causing the computer to generate sound representative of the selected music, so that an operator of the hand held type position input device participates as a member of the band.

2. A method of playing music extemporaneously on a computer having means for producing audible sound, comprising the steps of:

providing a hand held computer input device connected to the computer;

manually moving the hand held computer input device when a change from one musical note to another musical note is desired to communicate to the computer information which represents a desired sequence of musical notes and which is used by the computer to produce audible sound corresponding to the desired sequence of musical notes substantially simultaneously in response to movement of said hand held input device; and causing the computer to play automatically a musical piece based on information previously stored in the computer while simultaneously performing said step of mutually moving said hand held computer input device so that the computer plays said musical piece and said desired sequence of musical notes simultaneously.

3. The method according to claim 2, including the step of using the computer to ensure that the desired sequence of musical notes is confined to a musical scale which corresponds harmonically to said musical piece being played by the computer.

4. An apparatus comprising: a manually operable input device having a first part and having a second part which is movable relative to said first part, said input device outputting an electrical signal which represents the position of said second part relative to said first part and can have at least three different values; first means for outputting a first sequence of audible sounds representative of a music selection; and second means responsive to said input device for generating, simultaneously with said outputting of said sequence by said first means a second sequence of audible sounds which correspond to different values of said signal from said input device and which are generated substantially simultaneously in response to said different values of said signal from said input device.

5. An apparatus according to claim 4, wherein said second means includes means for confining said each sound of said second sequence to a musical note which is harmonically consistent with the sound being simultaneously generated according to said first sequence.

6. An apparatus according to claim 5, wherein said second means includes means for changing the pitch of a sound from said first and second parts, where the change in pitch is necessary to ensure that each said sound of said second sequence is harmonically consistent with sound being simultaneously generated in accord with said first sequence.

7. An apparatus according to claim 4, wherein said signal produced by said input device varies substantially continuously in value in response to a continuous movement of said second part relative to said first part.

8. An apparatus according to claim 4, wherein said input device has a manually operable first push-button switch thereon, said second means respectively enabling and disabling generation of said second sequence when said first push-button switch is respectively actuated and deactuated.

9. An apparatus according to claim 8, wherein said input device includes a manually operable second push-button switch, said second means being responsive to said second push-button switch being respectively deactuated and actuated for respectively permitting and preventing variation by said second means of said audible sound produced by said second means in response to relative movement of said first and second parts of said input device.

10. An apparatus according to claim 4, wherein said second means includes means for periodically checking a value of said signal from said input device, and for changing the pitch of the sound generated by said second means by an amount which corresponds to the amount of change in the value of said signal between an immediately preceding check of said signal and a current check of said signal.

11. An apparatus according to claim 4, wherein said first means includes means defining a plurality of different music selections, and including further means cooperable with said input device and said first means for selecting in response to relative manual movement of said first and second parts of said input device a respective one of said plurality of music selections as said music selection for which said first means outputs said first sequence of sounds.

12. An apparatus to claim 4, wherein said first means includes means defining a plurality of musicians and a unique characteristic style for each of said musicians, means responsive to relative manual movement of said first and second parts of said input device for selecting a subset of said musicians to be a band, and means for causing said first sequence to include for each said musician in said subset respective musical sounds which are characteristic of the playing style of such musician.

13. An apparatus according to claim 4, wherein said second part of said input device is capable of movement in two different dimensions relative to said first part, said second sequence of audible sounds being a function of movement of said second part relative to said first part in each of said two dimensions.

* * * * *

UNITED STATES PATENT AND TRADEMARK OFFICE

CERTIFICATE OF CORRECTION

PATENT NO. : 5 355 762

DATED : October 18, 1994

INVENTOR(S) : Toshiyuki TABATA

It is certified that error appears in the above-indentified patent and that said Letters Patent is hereby corrected as shown below:

On the title page, item [54] change the title "EXTEMPORANEOUS PLAYING SYSTEM BY POINTING DEVICE" to ---METHOD AND APPARATUS FOR EXTEMPORANEOUS GENERATION OF MUSICAL SOUNDS IN RESPONSE TO MANUAL OPERATION OF A MOUSE-TYPE INPUT DEVICE---.

Column 14, line 40; change "mutually moving" to ---manually moving---.

Column 14, line 58; after "means" insert ---,---.

Column 15, line 3; after "said" insert ---second sequence, even in the absence of relative movement of---.

Signed and Sealed this

Second Day of May, 1995

Bruce Lehman

*Attest:*

BRUCE LEHMAN

*Attesting Officer*

*Commissioner of Patents and Trademarks*